United States Patent [19]

Murayama

[11] Patent Number: 4,867,648

[45] Date of Patent: Sep. 19, 1989

[54] VARIABLE DISPLACEMENT WOBBLE PLATE TYPE COMPRESSOR FOR AUTOMOTIVE AIR CONDITIONER REFRIGERATION SYSTEM OR THE LIKE

[75] Inventor: Koji Murayama, Tokyo, Japan

[73] Assignee: Nihon Radiator Co., Ltd., Tokyo, Japan

[21] Appl. No.: 146,107

[22] Filed: Jan. 20, 1988

[30] Foreign Application Priority Data

Jan. 27, 1987 [JP] Japan ..... 62-15064

[51] Int. Cl.[4] ..... F04B 1/26

[52] U.S. Cl. ..... 417/222; 417/270

[58] Field of Search ..... 417/218, 222, 270; 91/506; 60/390

[56] References Cited

U.S. PATENT DOCUMENTS

| | | | |
|---|---|---|---|
| 3,646,754 | 3/1972 | Koch et al. | 60/390 |
| 3,942,486 | 3/1976 | Kirchner | 417/222 X |
| 4,037,993 | 7/1977 | Roberts | 417/222 S |
| 4,061,443 | 12/1977 | Black et al. | 417/222 |
| 4,428,718 | 1/1984 | Skinner | 417/222 |
| 4,492,527 | 1/1985 | Swain et al. | 417/222 |
| 4,506,648 | 3/1985 | Roberts | 417/222 X |
| 4,526,516 | 7/1985 | Swain et al. | 417/222 |
| 4,543,043 | 9/1985 | Roberts | 417/222 S |
| 4,687,419 | 8/1987 | Suzuki et al. | 417/222 |

FOREIGN PATENT DOCUMENTS

| | | |
|---|---|---|
| 36307/78 | 5/1978 | Australia . |
| 23929/77 | 10/1978 | Australia . |
| 30997/77 | 5/1979 | Australia . |
| 35846/78 | 11/1979 | Australia . |

*Primary Examiner*—William L. Freeh

*Attorney, Agent, or Firm*—Foley & Lardner, Schwartz, Jeffery, Schwaab, Mack, Blumenthal & Evans

[57] ABSTRACT

A wobble plate type compressor is equipped with a device which can be selectively activated in a manner to induce the wobble plate to assume a position wherein the displacement of the compressor is reduced to zero and thus obviate the need for a clutch for such purposes. The device further includes an arrangement which biases the wobble plate toward a position wherein a positive displacement of the compressor will occur when in a non-activated state. The strength of this bias is insufficient to interfere with the control of the wobble plate inclination by the pressure prevailing in the chamber in which the plate is disposed.

17 Claims, 2 Drawing Sheets

VARIABLE DISPLACEMENT WOBBLE PLATE TYPE COMPRESSOR FOR AUTOMOTIVE AIR CONDITIONER REFRIGERATION SYSTEM OR THE LIKE

BACKGROUND OF THE INVENTION

1. Field of the Invention

The present invention relates to a variable displacement wobble plate compressor for use in an automotive air conditioning system or the like and more specifically to such a compressor featuring a control arrangement which permits the output of the compressor to be selectively reduced to zero without the need of a clutch or the like to disconnect a drive connection between the compressor and a prime mover which drives the same.

2. Description of the Prior art

FIG. 1 shows a variable displacement type wobble plate type compressor disclosed in JP-A-58-158,382. This device is of the type wherein the suction pressure of the compressor is maintained essentially constant by controlling the amount of working fluid (viz., a refrigerant) discharged. This control is implemented by controlling the volume of the compression chambers of the compressor in accordance with the pressure of the refrigerant which returns to the compressor. With this arrangement when the suction pressure prevailing in the induction port of the compressor is controlled in a manner which holds the same essentially constant, the pressure of the refrigerant in the evaporator becomes essentially constant and permits exessively low evaporator surface temperatures which tend to induce freezing of water which has condensed on the evaporator, to be avoided.

The illustrated arrangement includes a drive shaft 11 which is operatively connected with an automotive engine (not shown in FIG. 1) via a pulley 2 and a magnetic clutch 2*a*. A drive rod 11*a* is provided on the drive shaft 11 and arranged to extend normally thereto. A drive plate 13 is pivotally connected to the drive rod by a pin 11*b* and arranged so that its angle of inclination with respect to the drive shaft 11 can be varied.

A wobble plate 16 is mounted on the drive plate 13 by way of a thrust bearing 14 and a radial bearing 15. The wobble plate 16 is provided with a shoe 19 which is slidably connected to a guide pin 18 fixed to the casing 17 of a crank chamber 12. This arrangement prevents the wobble plate 16 from rotating within the crank chamber 12 while allowing the inclination thereof to be varied.

A plurality of equally spaced piston or connecting rods 22 are connected to the wobble plate 16 by way of ball joints 22*a*. Pistons 23 are connected to the other ends of the connecting rods 22 by way of ball joints 22*b*.

When the drive plate 13 is rotated, the wobble plate is moved in a manner which induces each of the pistons 23 to undergo reciprocative movement in the cylinders or bores 26 formed in the cylinder block 25.

A cylinder head 30 is formed with an suction chamber 29 and a discharge chamber 33. The suction chamber 29 is arranged to communicate with a conduit through which refrigerant is returned from an evaporator (not shown). Inlet valves 34 operatively mounted on a valve plate 20 are arranged to control inlet ports 27 formed in a valve plate 20. Discharge valves (no numeral) also mounted on the valve plate 20 control the communication between cylinders 26 and the discharge chamber 33. The valve plate 20 is sandwiched between the cylinder head 30 and the cylinder block 25, and formed of three layers. The center layer is suitably recessed or apertured to form a communication passage structure therein as will become apparent hereinlater.

The pressure prevailing in the suction chamber 29 is supplied to an intake pressure chamber 32 by way of a connecting passage 32*a*. The discharge chamber 33 is communicated with a discharge pressure chamber 35 by way of a passage 35*a*.

A control valve Cv is disposed in a stepped bore formed in the cylinder head 30 and operatively disposed between the intake and discharge pressure chambers 32 and 35. This valve includes a first control valve element 36 disposed in the lower section of the valve body and a second valve element 39 disposed in the upper section thereof.

A bellows 37 forming part of the conrol valve Cv is arranged to expand and contract in a manner to establish an equilibrium between the pressure prevailing in the intake pressure chamber 32 and a spring 38 disposed in the bellows 37.

The first valve element 36 is operatively connected with the bellows and arranged to control the opening degree of a valve seat 40. The pressure prevailing in the intake pressure chamber 32 is introduced into the crank chamber 12 by way of the valve seat 40, passages 42 and 43, a bore 44 in which one end of the drive shaft 11 is operatively supported and an axial bore 45 formed in the drive shaft 11.

The first valve element 36 is formed with a push rod 47 which is engageable with the second valve element 39 in a manner which lifts it off its valve seat 47. The first and second valve elements 36 and 39 are arranged so that as the first valve element 36 is moved toward a closed position the second valve element 39 is moved toward an open one and vice versa.

With this arrangement when the thermal load on the evaporator is low, the refrigerant which is returned to the compressor has not absorbed much heat and thus produces a relatively low pressure in the induction chamber 29. Under these conditions the bellows 37 tends to expand and move the first and second valve elements upwardly as seen in the drawings. This movement tends to move the first valve element 36 toward a closed position and the second valve element 39 toward an open one. Accordingly, the pressure prevailing in the discharge chamber 33 tends to be supplied into the crank chamber 12 via passages 48 and 49.

The angle or amount of inclination of the wobble plate is controlled by the pressure prevailing in the crank chamber 12. When the pressure in the crank chamber increases and exceeds that prevailing in suction chamber 29, the pressure differential acting across the pistons 23 is such as to induce the situation wherein a moment of force which rotates the wobble plate 16 and the drive plate 13 about pin 11*b* in a direction which reduces the angle of inclination.

Under such conditions the stroke of the pistons 23 is reduced and the amount of refrigerant discharged by the compressor is correspondingly reduced. As the amount of refrigerant circulated through the system is reduced the amount of heat absorber per unit volume of the refrigerant increases and the pressure prevailing in the suction chamber 29 is gradually increased and an essentially constant induction pressure is resultingly maintained.

When the thermal load on the evaporator is high, the pressure in the suction chamber 29 increases. This induces the bellows 37 to contract and cause the second valve element 39 to move toward a closed position and the first one 36 to move toward an open one.

Under these conditions the pressure prevailing in the crank chamber 12 tends to become equal to that in the suction chamber 29. Further, as the pressure differential across the pistons 23 during their respective suction strokes is essentially zero, the pistons are permitted to move unrestrictedly toward the end of their bores. This, in combination with the counterforce generated during the compression strokes produces a moment of force which tends to rotate the wobble plate 16 in a manner which increases its degree of inclination. This increases the amount of refrigerant discharged by the compressor and increases the amount of refrigerant which is circulated through the circuit including the evaporator. This lowers the pressure prevailing in the suction chamber and again results in an essentially constant suction pressure being maintained.

The above described arrangement has encountered the drawback that if the wobble plate is permitted to assume a position wherein it is normal to the drive shaft 11, no backpressure is developed and it is difficult to get the compressor to again discharge refrigerant.

Accordingly, a spring 50 has been provided which ensures that upon start-up the wobble and drive plates 16, 13 will be biased sufficiently to ensure that refrigerant discharge can always be induced when required. However, provision of this spring 50 requires that the clutch **2*a*** be provided to enable the compressor output to be selectively reduced to zero.

The provision of this clutch **2*a*** which includes an iron core, coils, roller bearings and the like, complicates the constuction and increases the weight of the device as a whole. This increases both the production costs and the fuel consumption of the vehicle to which it is applied.

SUMMARY OF THE INVENTION

It is an object of the present invention to provide a wobble plate type compressor arrangement which does not require the use of a clutch to enable the output of the compressor to be selectively reduced to zero while the engine with which it is associated is still operating, and which arrangement is both light and exhibits a reduced production cost.

In brief, the above object is achieved via the provision of a device which can be selectively activated in a manner to induce the wobble plate to assume a position wherein the displacement of the compressor is reduced to zero and thus obviate the need for a clutch for such purposes. The device further inludes an arrangement which biases the wobble plate toward a position wherein a positive displacement of the compressor will occur when in a non-activated state. The strength of this bias is insufficient to interfere with the control of the wobble plate inclination by the pressure prevailing in the chamber in which the plate is disposed.

More specifically, a first aspect of the present invention comes in the form of a variable displacement compressor which features: a drive shaft connected with a source of rotational energy; a drive plate pivotally mounted on the drive shaft for synchronous rotation therewith; a non-rotative wobble plate, the wobble plate being disposed in a in crank chamber of the compressor and operatively connected with the drive plate in manner which, when inclined with respect to the drive shaft, moves the wobble plate and induces a piston connected thereto to reciprocate; and a device operatively connected with the wobble plate, the device having a first active state wherein it selectively induces the wobble plate to assume a position normal to the drive shaft and in which position the reciprocative stroke of the piston is reduced to zero.

A second aspect of the invention comes in the form of a system which features: a variable displacement wobble plate compressor, the compressor having a crankcase, the compressor being so constructed and arranged that the displacement of the compressor is controlled by the pressure in the crankcase; an inclination control device operatively connected with the wobble plate of the compressor, the device having a first state wherein it selectively induces the wobble plate to assume a position wherein the displacement of the compressor is reduced to zero.

DETAILED DESCRIPTION OF THE PREFERRED EMBODIMENTS

Figure 1:
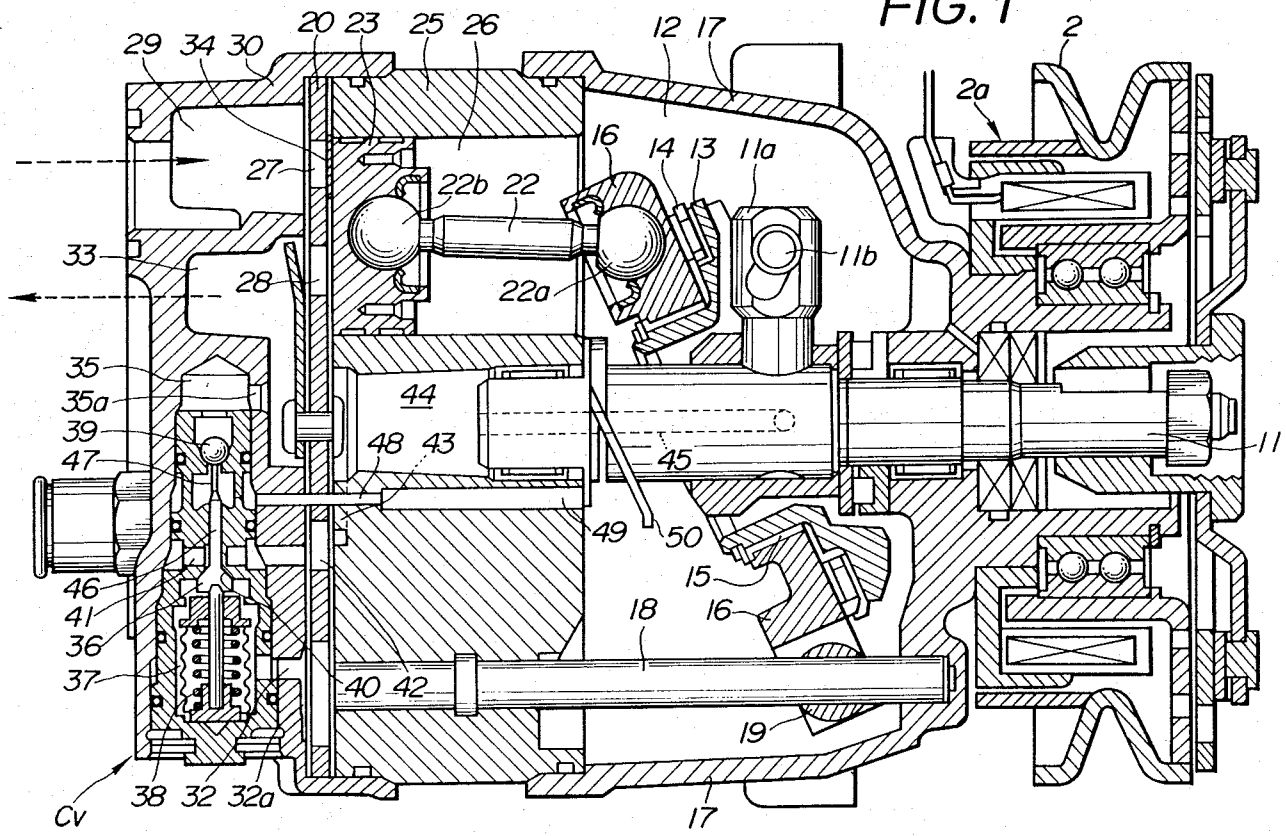
PRIOR ART FIG. 1
FIG. 1 is a sectional elevation showing the prior art arrangement discussed in the opening paragraphs of the instant specification.
Figure 2:
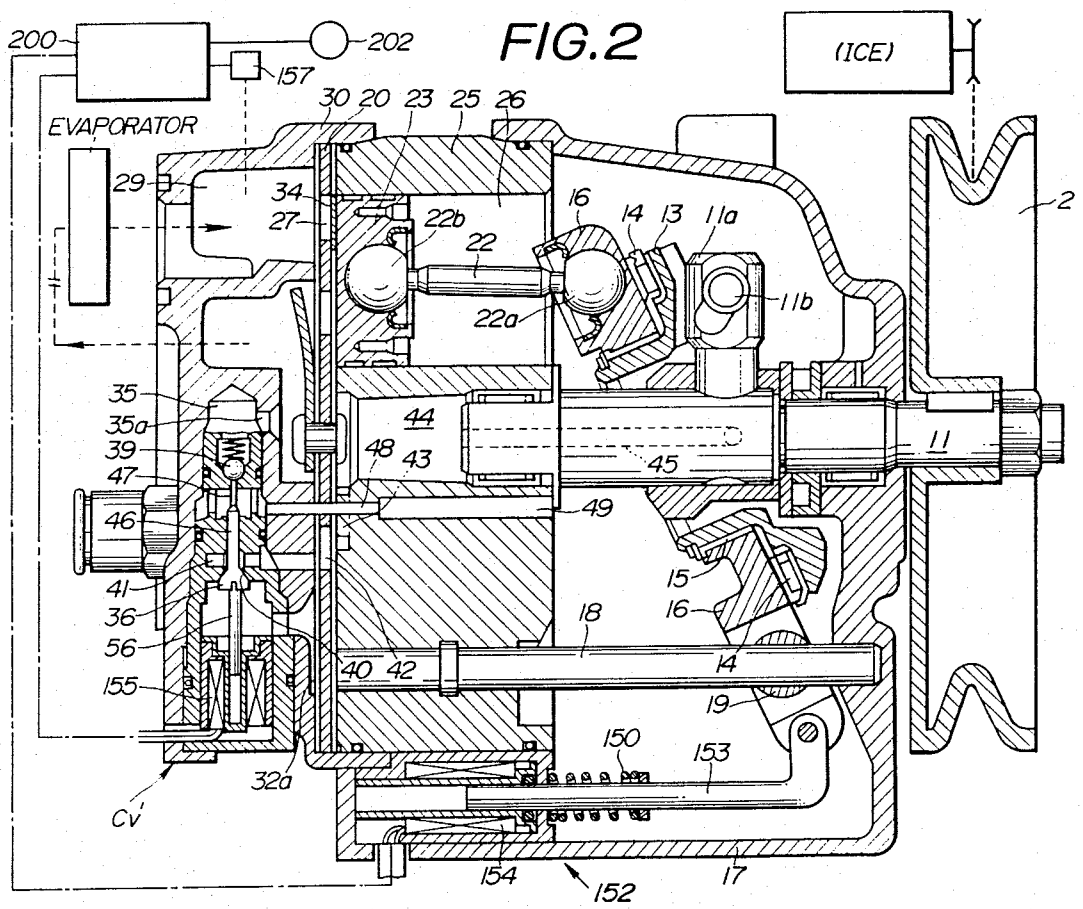
FIG. 2 is a sectional elevation showing an embodiment of the present invention.

FIG. 2 shows an embodiment of the present invention. As will be appreciated the embodiment shown in FIG. 2 is basically similar to the prior art arrangement shown in FIG. 1 and as such like elements are denoted by like numerals. A redundant description of the same is omitted for brevity.

In this embodiment the wobble plate 16 is connected with the inclination control device generally denoted by the numeral 152. This device includes a control rod 153 which is pivotally connected at one end to the lower end (as seen in the drawings) of the wobble plate 16. Viz., a portion of the wobble plate which is distal from the pin **11*b* about which it and the drive plate 13 are pivotal. The other end of the control rod 153 is disposed in an electromagnetic linear acting motor (solenoid) 154 which, when energized, moves the wobble plate 16 by way of control rod 153 and induces the plate to assume a position normal with respect to the drive shaft 11**.

A return spring 150 is interposed between the motor and a stopper provided on the control rod 153. This spring 150 is arranged to bias the wobble plate 16 to assume a given inclination when the motor 154 is deenergized. This ensures that when the compressor is initially put in operation after a non-operative period the wobble plate 16 will be sufficiently inclined and that the compressor will displace some refrigerant and therefore immediately become operative. The bias of the spring 150 is not sufficient to interere with the inclination control provided by the pressure in the crank chamber 12.

The above described arrangement permits the wobble plate 16 to be selectively moved to a position normal with respect to the drive shaft 11 and retained therein during operation of the vehicle engine and therefore selectively reduce the compressor output to zero without recourse to the provision of an electromagnetic clutch or the like. The return spring also 150 ensures that when the motor 154 is de-energized the wobble plate will be moved from the perpendicular position (zero inclination) to one where a positive displacement occurs and therefore instantly restore the operability of the device.

It will of course be noted that the present invention is not limited to the use of solenoid motors and encompasses the use of vacuum powered servo devices, manually operated cables and the like.

While it is possible to utilize the above described arrangement in combination with a compressor of the nature of the prior art arrangement disclosed in connection with FIG. 1 it is deemed advantageous to combine this arrangement with an electronically controlled valve Cv' to further improve the control of the pressure prevailing in the crank chamber of the compressor.

The valve is essentially similar to the arrangement shown in FIG. 1 but features the provision of a solenoid 155 in place of the bellows 37. This arrangement further includes a pressure sensor 157 which is arranged to be responsive to the pressure prevailing in the induction chamber 29 and output a signal indicative thereof. The output of the pressure sensor 157 is applied to a control circuit 200 which in this instance includes a microprocessor. The microprocessor includes a RAM, ROM, CPU and may advantageously further include architecture which enables onboard A/D conversion of the outputs of the pressure sensor 157 and control 202 via which the desired temperature can be selected. If desired, further data input can be provided using an ambient air temperature sensor disposed in a shaded location of the vehicle body.

The above mentioned microprocessor includes a control program which determines, based on the data inputted thereto, the appropriate duty cycle to be applied to the solenoid 155. Depending on the duty cycle of the signal applied to the solenoid the effective opening degree of the first and second valve elements can be controlled in a manner to provide the appropriate pressure level in the crank chamber.

For further disclosure relating to this mode of control reference may be had to applicants (Koji Murayama) copending U.S. application Ser. No. 133,645) which was filed in Dec. 1987. This application relates to controlling the pressure prevailing in the crank case of a wobble plate type compressor by calculating the required suction pressure required in view of the ambient atmospheric temperature and the temperature to which the air cooled via heat exchange with the evaporator of the system is required to be controlled. The induction pressure is controlled by varying the duty cycle of the signal applied to a solenoid controlled valve which controls the pressure in the compressor crank case. The content of this document is hereby incorporated by reference thereto.

For disclosure relating to the construction and arrangement of the FIG. 1 prior art device reference by be had to U.S. Pat. No. 4,428,718 issued on Jan. 31, 1984 in the name of Skinner. The content of this document is also incorporated by reference thereto.

What is claimed is:

1. In a variable displacement compressor for discharging refrigerant having a crankcase, said compressor being so constructed and arranged that the displacement of said compressor is controlled by the pressure in said crankcase, said pressure being controlled by a valve, a drive shaft connected with a source of rotational energy;

a drive plate pivotally mounted on said drive shaft for synchronous rotation therewith;

a non-rotative wobble plate, said wobble plate being disposed in a crank chamber of said compressor and operatively connected with said drive plate in a manner which, when inclined with respect to said drive shaft, moves the wobble plate and induces a piston connected thereto to reciprocate; and a device operatively connected with said wobble plate, said compressor having an active state wherein said device selectively induces said wobble plate to assume a position normal to said drive shaft and in which position the reciprocative stroke of said piston is reduced to zero, and said compressor having a non-active state wherein said device biases said wobble plate toward a position inclined with respect to said drive shaft, whereby said device permits backpressure to be developed and refrigerant to be discharged when said compressor is switched from its non-active state to its active state.

2. In a variable displacement compressor for discharging refrigerant having a crankcase, said compressor being so constructed and arranged that the displacement of said compressor is controlled by the pressure in said crankcase, said pressure being controlled by a valve, a drive shaft connected with a source of rotational eneregy;

a drive plate pivotally mounted on said drive shaft for synchronous rotation therewith;

a non-rotative wobble plate, said wobble plate being disposed in a crank chamber of said compressor and operatively connected with said drive plate in a manner which, when inclined with respect to said drive shaft, moves the wobble plate and induces a piston connected thereto to reciprocate; and a device operatively connected with said wobble plate, said compressor having an active state wherein said device selectively induces said wobble plate to assume a position normal to said drive shaft and in which position the reciprocative stroke of said piston is reduced to zero, and said compressor having a non-active state wherein said device biases said wobble plate toward a position inclined with respect to said drive shaft, whereby said device permits backpressure to be developed and refrigerant to be discharged when said compressor is switched from its non-active state to its active state; and wherein said device takes the form of a solenoid motor which when energized moves said wobble plate to said positon normal to said drive shaft.

3. A variable displacement compressor as claimed in claim 2 further comprising a spring which biases said wobble plate in a manner to assume an inclination with respect to said drive shaft when said solenoid is not energized.

4. In a variable displacement compressor for discharging refrigerant having a crankcase, said compressor being so constructed and arranged that the displacement of said compressor is controlled by the pressure in said crankcase, said pressure being controlled by a valve, a drive shaft connected with a source of rotational energy;

a drive plate pivotally mounted on said drive shaft for synchronous rotation therewith;

a non-rotative wobble plate, said wobble plate being disposed in a crank chamber of said compressor and operatively connected with said drive plate in a manner which, when inclined with respect to said drive shaft, moves the wobble plate and induces a piston connected thereto to reciprocate; and a device operatively connected with said wobble plate, said compressor having an active state wherein said device selectively induces said wobble plate to assume a position normal to said drive shaft and in which position the reciprocative stroke of said piston is reduced to zero, and said compressor having a non-active state wherein said device biases said wobble plate toward a position inclined with respect to said drive shaft, whereby said device permits backpressure to be developed and refrigerant to be discharged when said compressor is switched from its non-active state to its active state; and wherein said device takes the form of a rod which is pivotally connected to said wobble plate; and means associated with said rod for selectively moving said rod in a manner which moves said wobble plate to a position wherein it is normal with respect to said drive shaft.

5. In a variable displacement compressor for discharging refrigerant having a crankcase, said compressor being so constructed and arranged that the displacement of said compressor is controlled by the pressure in said crankcase, said pressure being controlled by a valve, a drive shaft connected with a source of rotational energy;

a drive plate pivotally mounted on said drive shaft for synchronous rotation therewith;

a non-rotative wobble plate, said wobble plate being disposed in a crank chamber of said compressor and operatively connected with said drive plate in a manner which, when inclined with respect to said drive shaft, moves the wobble plate and induces a piston connected thereto to reciprocate;

a device operatively connected with said wobble plate, said compressor having an active state wherein said device selectively induces said wobble plate to assume a position normal to said drive shaft and in which position the reciprocative stroke of said piston is reduced to zero, and said compressor having a non-active state wherein said device biases said wobble plate toward a position inclined with respect to said drive shaft, whereby said device permits backpressure to be developed and refrigerant to be discharged when said compressor is switched from its non-active state to its active state;

a sensor arrangement; and a control circuit responsive to said sensor arrangement for controlling the operation of said valve in a manner to selectively vary the pressure prevailing in said crankcase to a level determined in accordance with the data supplied by said sensor arrangement.

6. In a system for discharging refrigerant, a variable displacement wobble plate compressor, said compressor having a crankcase, said compressor being so constructed and arranged that the displacement of the compressor is controlled by the pressure in said crankcase; and an inclination control device operatively connected with the wobble plate of said compressor, said compressor having an active state wherein said device selectively induces said wobble plate to assume a position wherein the displacement of said compressor is reduced to zero, and said compressor having an inoperative state wherein said device biases said wobble plate toward a position wherein a given displacement is induced whereby said device allows backpressure to be developed and refrigerant to be discharged when said compressor is switched to its active state.

7. A system as claimed in claim 6 wherein said bias is insufficient to interfer with the displacement control produced by the pressure prevailing in said crankcase.

8. A system for discharging refrigerant, comprising a variable displacement wobble plate compressor, said compressor having a crankcase, said compressor being so constructed and arranged that the displacement of the compressor is controlled by the pressure in said crankcase;

an inclination control device operatively connected with the wobble plate of said compressor, said compressor having an active state wherein said device selectively induces said wobble plate to assume a position wherein the displacement of said compressor is reduced to zero, and said compressor having an inoperative state wherein said device biases said wobble plate toward a position wherein a given displacement is induced whereby said device allows backpressure to be developed and refrigerant to be discharged when said compressor is switched to its active state;

a valve for controlling the pressure in said crankcase;

a sensor arrangement for determining temperature data pertinent to the control of the compressor;

a pressure sensor responsive to the induction pressure of the compressor; and a control circuit responsive to said sensor arrangement and said pressure sensor for controlling the operation of said valve in a manner to selectively vary the pressure prevailing in said crankcase.

9. A system for discharging refrigerant, comprising:

a variable displacement wobble plate compressor, said compressor having a crankcase, said compressor being so constructed and arranged that the displacement of the compressor is controlled by the pressure in said crankcase;

an inclination control device operatively connected with the wobble plate of said compressor, said compressor having an active state wherein said device selectively induces said wobble plate to assume a position wherein the displacement of said compressor is reduced to zero, and said compressor having an inoperative state wherein said device biases said wobble plate toward a position wherein a given displacement is induced whereby said device allows backpressure to be developed and refrigerant to be discharged when said compressor is switched to its active state; and a sensor arrangement for determining temperature data pertinent to the control of the compressor;

said sensor arrangement comprising an ambient temperature sensor; and a sensor responsive to the setting of a manually operable control element via which the temperature to which the evaporator is required to be controlled, is selected.

10. A refrigeration system comprising:

a variable displacement wobble plate compressor, said compressor having a crankcase, said compressor being so constructed and arranged that the displacement of the compressor is controlled by the pressure in said crankcase;

an inclination control device operatively connected with the wobble plate of said compressor, said compressor having an active state wherein said device selectively induces said wobble plate to assume a position wherein the displacement of said compressor is reduced to zero, and said compressor having an inoperative state wherein said device biases said wobble plate toward a position wherein a given displacement is induced whereby said device allows backpressure to be developed and refrigerant to be discharged when said compressor is switched to its active state;

a pressure sensor responsive to the induction pressure of the compressor, and wherein said pressure sensor is disposed in one of an evaporator associated with the compressor and an induction port of the compressor.

11. A system as claimed in claim 10 wherein said refrigeration system forms part of an automotive air conditioning unit and wherein said compressor is continously driven by the engine of said vehicle.

12. A system for discharging refrigerant, comprising:

a variable displacement wobble plate compressor, said compressor having a crankcase, said compressor being so constructed and arranged that the displacement of the compressor is controlled by the pressure in said crankcase;

an inclination control device operatively connected with the wobble plate of said compressor, said compressor having an active state wherein said device selectively induces said wobble plate to assume a position wherein the displacement of said compressor is reduced to zero, and said compressor having an inoperative state wherein said device biases said wobble plate toward a position wherein a given displacement is induced whereby said device allows backpressure to be developed and refrigerant to be discharged when said compressor is switched to its active state;

said compressor having an induction port and a discharge port and wherein said valve selectively controls the communication between said crankcase and the induction and discharge ports in a manner which varies the pressure prevailing in the crankcase.

13. A variable displacement compressor, comprising:

a crankcase defining a chamber therein;

a drive shaft located in said chamber and connected with a source of rotational energy;

a drive plate pivotally mounted on said drive shaft for synchronous rotation therewith;

at least one piston reciprocal in a compression chamber having a suction and a discharge port;

a non-rotative wobble plate, said wobble plate being disposed a said crankcase chamber of said compressor and operatively connected with said drive plate in a manner which, when the wobble plate is inclined with respect to said drive shaft, moves the wobble plate and induces said piston connected thereto to reciprocate;

means for selectively controlling the pressure in said crankcase chamber to control the angle of inclination of said wobble plate; and a device operatively connected with said wobble plate, said device having a first active state wherein it selectively induces said wobble plate to assume a position normal to said drive shaft and in which position the reciprocative stroke of said piston is reduced to zero, wherein said device comprises:

a rod which is pivotally connected to said wobble plate; and means associated with said rod for selectively moving said rod in a manner which moves said wobble plate to a position wherein it is normal with respect to said drive shaft, whereby a separate clutch is not required to connect said drive shaft to the source of rotational energy.

14. In a system including a variable displacement wobble plate compressor, said compressor having a crankcase, at least one compressor member reciprocally movable in a compression chamber having a suction port and a discharge port, wherein displacement of the compression member is controlled by the pressure in said crankcase, said compressor further having a valve for controlling the pressure in said crankcase, wherein the improvement comprises:

an inclination control device operatively connected with the wobble plate of said compressor, said device having a first state wherein it selectively induces said wobble plate to assume a position wherein the displacement of the compressor is reduced to zero;

a sensor arrangement for determining temperature data pertinent to the control of the compressor;

a pressure sensor responsive to the suction pressure of the compressor; and a control circuit responsive to said sensor arrangement and said pressure sensor for controlling the operation of said valve in a manner to selectively vary the pressure prevailing in said crankcase, wherein said sensor arrangement comprises:

an ambient temperature sensor; and a sensor responsive to the setting of a manually operable control element via which the temperature to which the evaporator is required to be controlled, is selected.

15. A variable displacement compressor, comprising:

a crankcase defining a chamber therein;

a drive shaft located in said chamber and connected with a source of rotational energy;

a drive plate pivotally mounted on said drive shaft for synchronous rotation therewith;

at least one piston reciprocal in a compression chamber having a suction and a discharge port;

a non-rotative wobble plate, said wobble plate being disposed a said crankcase chamber of said compressor and operatively connected with said drive plate in a manner which, when the wobble plate is inclined with respect to said drive shaft, moves the wobble plate and induces said piston connected thereto to reciprocate;

means for selectively controlling the pressure in said crankcase chamber to control the angle of inclination of said wobble plate; and a device operatively connected with said wobble plate, said device having a first active state wherein it selectively induces said wobble plate to assume a position normal to said drive shaft and in which position the reciprocative stroke of said piston is reduced to zero, wherein said device comprises a solenoid motor which when energized moves said wobble plate to said position normal to said drive shaft, whereby a separate clutch is not required to connect said drive shaft to the source of rotational energy.

16. A variable displacement compressor as claimed in claim 15, wherein said device has a second non-active state wherein it biases the wobble plate toward a position inclined with respect to said drive shaft.

17. A variable displacement compressor as claimed in claim 16, further comprising a spring which biases said wobble plate in a manner to assume an inclination with respect to said drive shaft when said solenoid is not energized.

* * * * *